US010923822B2

(12) United States Patent
Choi et al.

(10) Patent No.: US 10,923,822 B2
(45) Date of Patent: Feb. 16, 2021

(54) WIRELESS COMMUNICATIONS ANTENNA

(71) Applicant: WITS Co., Ltd., Yongin-si (KR)

(72) Inventors: Tae Jun Choi, Suwon-si (KR); Jung Young Cho, Suwon-si (KR); Seung Hee Oh, Suwon-si (KR); Sung Nam Cho, Suwon-si (KR); Chang Hak Choi, Suwon-si (KR)

(73) Assignee: WITS Co., Ltd., Gyeonggi-do (KR)

( * ) Notice: Subject to any disclaimer, the term of this patent is extended or adjusted under 35 U.S.C. 154(b) by 312 days.

(21) Appl. No.: 16/011,915

(22) Filed: Jun. 19, 2018

(65) Prior Publication Data

US 2019/0173183 A1 Jun. 6, 2019

(30) Foreign Application Priority Data

Dec. 6, 2017 (KR) ..... 10-2017-0166709

(51) Int. Cl.

| | |
|---|---|
| ***H01Q 7/08*** | (2006.01) |
| ***H01Q 1/22*** | (2006.01) |
| ***H01Q 1/38*** | (2006.01) |
| ***H01Q 1/44*** | (2006.01) |
| ***H01Q 1/24*** | (2006.01) |
| ***H01Q 1/00*** | (2006.01) |

(52) U.S. Cl.
CPC ..... *H01Q 7/08* (2013.01); *H01Q 1/00* (2013.01); *H01Q 1/2225* (2013.01); *H01Q 1/243* (2013.01); *H01Q 1/38* (2013.01); *H01Q 1/44* (2013.01)

(58) Field of Classification Search
CPC .. H01Q 7/08; H01Q 1/00; H01Q 1/22; H01Q 1/24; H01Q 1/38; H01Q 1/44
USPC ..... 343/788
See application file for complete search history.

(56) References Cited

U.S. PATENT DOCUMENTS

2011/0124299 A1 5/2011 Koujima et al.
2013/0135165 A1* 5/2013 Yamaguchi ..... H01Q 7/06 343/788
2014/0239892 A1 8/2014 Sawa et al.

FOREIGN PATENT DOCUMENTS

KR 10-1663839 B1 10/2016
WO WO 2013/069270 A1 5/2013

* cited by examiner

*Primary Examiner* — Andrea Lindgren Baltzell
(74) *Attorney, Agent, or Firm* — Harness, Dickey & Pierce, P.L.C.

(57) ABSTRACT

A wireless communications antenna includes: a magnetic body including one or more slits formed therein; and a coil part having solenoid form and disposed around the magnetic body, wherein the one or more slits are configured such that the magnetic body is not disconnected and a magnetic path of the magnetic body is continuous.

18 Claims, 9 Drawing Sheets

WIRELESS COMMUNICATIONS ANTENNA

CROSS-REFERENCE TO RELATED APPLICATIONS

This application claims the benefit under 35 U.S.C. § 119(a) of Korean Patent Application No. 10-2017-0166709 filed on Dec. 6, 2017 in the Korean Intellectual Property Office, the entire disclosure of which is incorporated herein by reference for all purposes.

BACKGROUND

1. Field

The following description relates to a wireless communications antenna used in a mobile device, for example.

2. Description of Related Art

Wireless communications are applied to various applications. In particular, a wireless communications antenna having a form of a coil and used in connection with electronic approval may be applied to various devices. A mobile device has recently included a wireless communications antenna having a form of a spiral coil attached to a cover of the mobile device.

Such a wireless communications antenna used in an electronic approval process, as an example, employs a solenoid coil structure in which a coil is wound around a magnetic body. In this case, an induced magnetic field generated when an electric filed is applied may cause a volume change of the magnetic body. In addition, noise may occur during the electronic approval due to such a volume change of the magnetic body.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a wireless communications antenna includes: a magnetic body including one or more slits formed therein; and a coil part having solenoid form and disposed around the magnetic body, wherein the one or more slits are configured such that the magnetic body is not disconnected and a magnetic path of the magnetic body is continuous.

The one or more slits may extend in a direction perpendicular to a direction of a magnetic field of the coil part.

The one or more slits may have a shape extending in the direction perpendicular to the direction of the magnetic field of the coil part from side surfaces of the magnetic body.

The one or more slits may be spaced apart from each other in a direction parallel to the direction of the magnetic field of the coil part.

The one or more slits may be arranged in a left and right symmetrical structure in relation to a center line parallel to the direction of the magnetic field of the coil part in the magnetic body.

A slit, among the one or more slits, formed on one side surface of the magnetic body and a slit, among the one or more slits, formed another side surface of the magnetic body may be alternately disposed in the direction parallel to the direction of the magnetic field of the coil part.

The one or more slits may have a shape extending in the direction perpendicular to the direction of the magnetic field of the coil part in one region in the magnetic body.

The one or more slits may not be formed on side surfaces of the magnetic body.

The one or more slits may be inclined at an angle wider than 0° and narrower than 90° with respect to a direction perpendicular to a direction of the magnetic field of the coil part.

The one or more slits may penetrate through the magnetic body in a thickness direction.

The one or more slits may have a trench shape that does not penetrate entirely through the magnetic body in a thickness direction.

The magnetic body may have a magnetostriction coefficient of 5 or more.

The coil part may have a first wiring part disposed on a first surface of the magnetic body, a second wiring part disposed on a second surface of the magnetic body, and conductive vias connecting the first wiring part and the second wiring part to each other.

In another general aspect, a wireless communications antenna includes a magnetic body including slits formed therein; and a coil part having solenoid form and disposed around the magnetic body, wherein first slits, among the slits are formed in a direction perpendicular to a direction of a magnetic field of the coil part, and second slits, among the slits, are formed in a direction parallel to the direction of the magnetic field of the coil part.

The coil part may be wound around only a region of the magnetic body in which the second slits are formed.

The coil part may not be formed in a region of the magnetic body in which the first slits are formed.

The first slits may be disposed in a first portion of the magnetic body and may separate the first portion of the magnetic body into disconnected pieces.

The second slits may be formed in a second portion of the magnetic body and may not separate the second portion of the magnetic body into disconnected pieces.

The coil part may be wound around only the second portion of the magnetic body.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
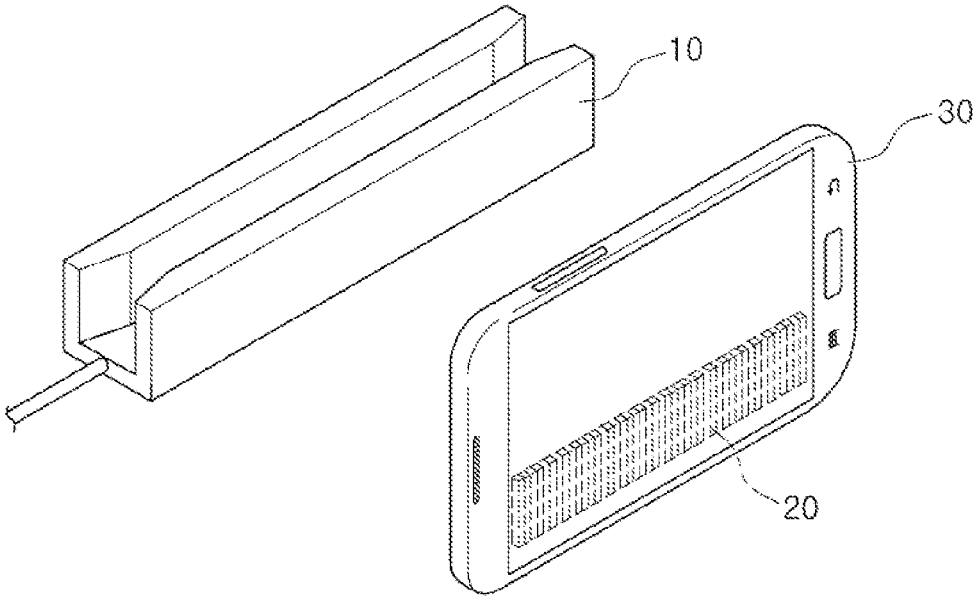
FIG. 1 is a perspective view illustrating an example in which a mobile device, according to an embodiment, performs wireless communications.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

FIG. 1 is a perspective view illustrating an example in which a mobile device 30, according to an embodiment, performs wireless communications. A magnetic card reader 10, which is a wireless signal receiver, is illustrated in FIG. 1. According to embodiments, the wireless signal receiver includes a receiving coil. Various wireless signal receivers may be used in addition to the magnetic card reader 10.

A wireless communications antenna 20 may be applied to the mobile device 30. The wireless communications antenna 20 may form a magnetic field under control of the mobile device 30. In addition, the wireless communications antenna 20 may operate as a transmitting coil, and may be magnetically coupled to a wireless signal receiver including a receiving coil to thereby wirelessly transmit information.

According to an embodiment, the wireless communications antenna 20 may transmit data such as card number data, intended to be transmitted to the magnetic card reader 10 by changing a direction of the magnetic field. In other words, the magnetic card reader 10 may generate the card number data using a change in a voltage across the receiving coil caused by the change in the magnetic field formed by the wireless communications antenna 20.

Hereinafter, a magnetic coupling between the wireless communications antenna 20 and the magnetic card reader 10, and an operation of the magnetic card reader 10 will be described in more detail with reference to FIGS. 2 and 3.

Figure 2:
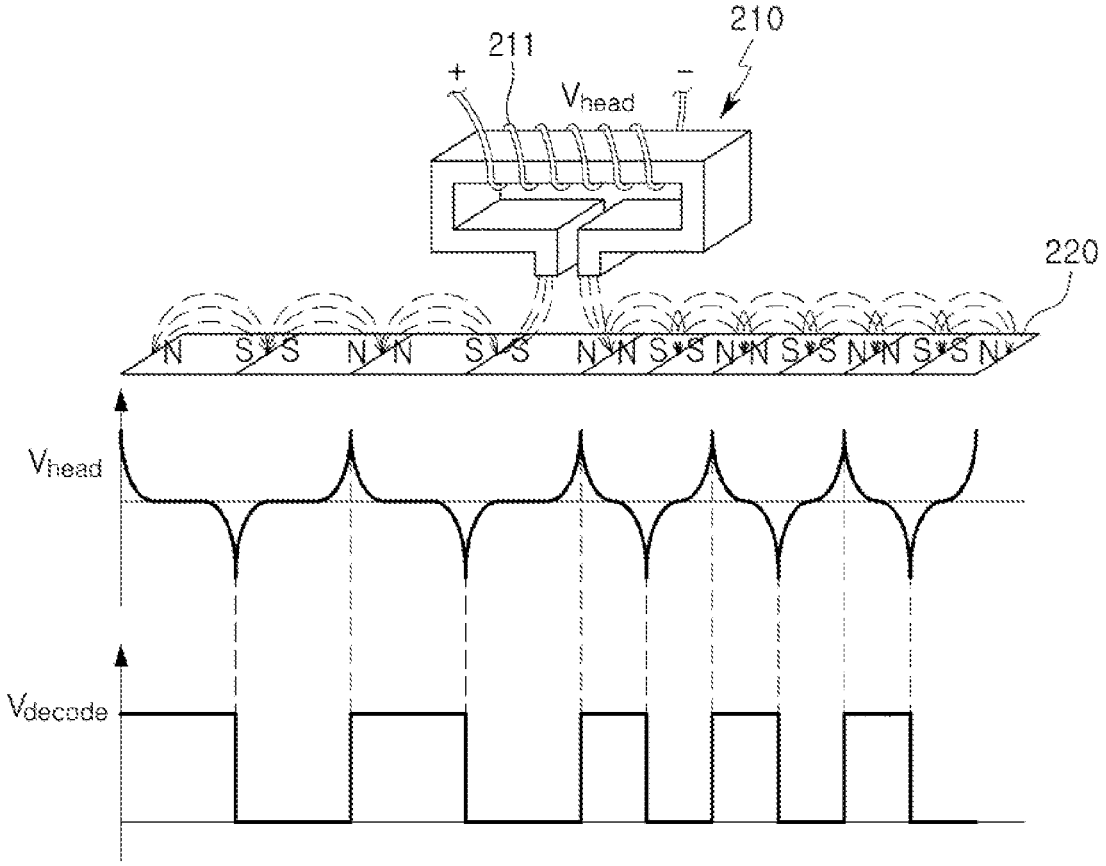
FIG. 2 is a view illustrating an example of a voltage across a magnetic head adjacent to a magnetic card.

FIG. 2 is a view illustrating a voltage across a magnetic head 210 adjacent to a magnetic card, according to an embodiment.

The magnetic card reader 10 (FIG. 1) may include the magnetic head 210 and an analog-digital converter (not shown). The magnetic head 210 may generate a voltage by magnetic flux. That is, the magnetic head 210 may include a receiving coil 211, and may detect a voltage $V_{head}$ generated by the magnetic field across the receiving coil 211.

When the receiving coil 211 experiences a change in the magnetic field, a voltage $V_{head}$ may be generated across the receiving coil 211 by the magnetic flux. The voltage $V_{head}$ generated across the receiving coil 211 may be provided to the analog-digital converter, and the analog-digital converter may generate a decoded signal $V_{decode}$ from the voltage $V_{head}$ across the receiving coil 211. The decoded signal $V_{decode}$ is, for example, a digital voltage signal, and card information data may be generated from the decoded signal $V_{decode}$.

The magnetic card may have a magnetized magnetic stripe 220. As the magnetic head 210 is moved over the magnetic stripe 220, the voltage $V_{head}$ may be generated across the receiving coil 211 of the magnetic head 210 by the magnetic flux. The voltage $V_{head}$ across the receiving coil 211 may have a peak voltage depending on polarities of the magnetic stripe 220. For example, in a case in which the same polarities are adjacent to each other-S to S, or N to N–, the voltage $V_{head}$ across the receiving coil 211 may have the peak voltage. In addition, the analog-digital converter may generate the decoded signal $V_{decode}$ from the voltage $V_{head}$ across the receiving coil. For example, the analog-digital converter may generate an edge whenever the peak voltage is detected to generate the decoded signal $V_{decode}$.

The decoded signal $V_{decode}$ may be a digital voltage signal from which digital data is decoded. For example, depending on a length of a period of the decoded signal $V_{decode}$, a '1' or '0' may be decoded. It may be seen from an illustrated example that a first period and a second period of the decoded signal $V_{decode}$ are two times as long as a third period of the decoded signal $V_{decode}$. Therefore, the first period and the second period of the decoded signal $V_{decode}$ may be decoded to '1', and a third period to a fifth period may be decoded to '0'. Such a decoding method is illustrative, and it should be apparent to one of skill in the art, after gaining a full understanding of the disclosure, that various decoding technologies may be applied.

FIG. 2 illustrates an example in which the magnetic card reader 10 performs the decoding from the magnetized magnetic stripe 220. The magnetic head 210 is capable of generating the voltage across the receiving coil 211 from the magnetic field generated by the wireless communications antenna 20 as well as the magnetized magnetic stripe 220. That is, the magnetic head 210 of the magnetic card reader may be magnetically coupled to the transmitting coil of the wireless communications antenna 20 to receive data such as card number data.

Figure 3:
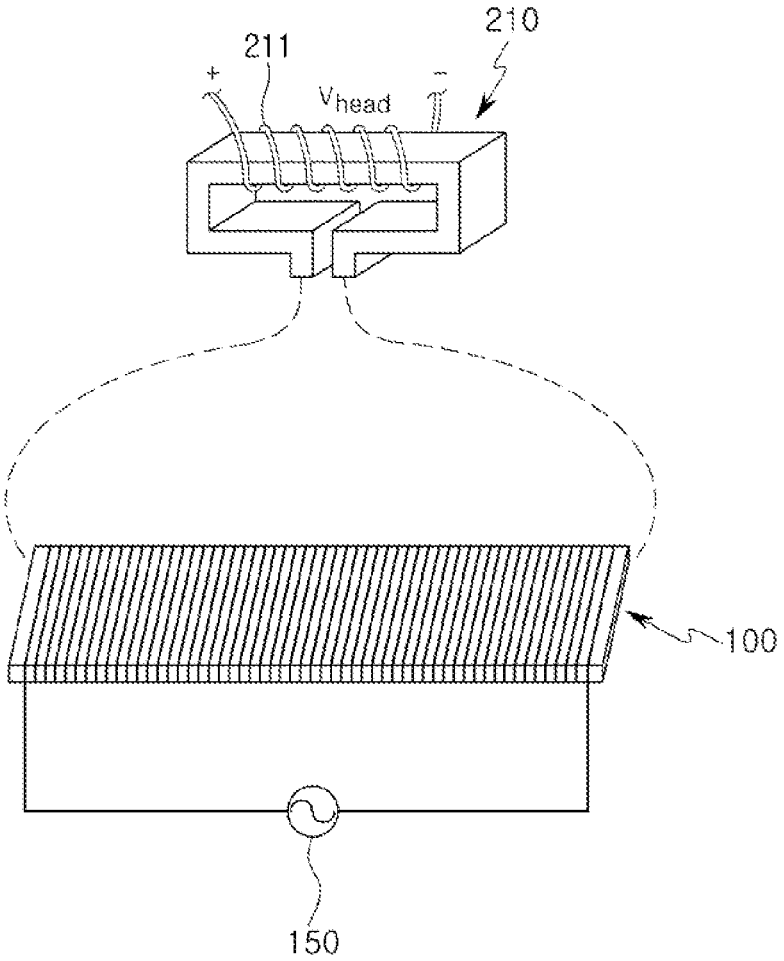
FIG. 3 is a view illustrating an example in which a magnetic head of a magnetic card reader is magnetically coupled to a wireless communications antenna, according to an embodiment.

FIG. 3 is a view illustrating an example in which a magnetic head of a magnetic card reader is magnetically coupled to a wireless communications antenna 100, according to an embodiment. A driving signal from a driving signal generator 150 may be applied to the wireless communications antenna 100 to form a magnetic field. The magnetic head 210 may be magnetically coupled to the magnetic field formed by the transmitting coil to receive data.

Figure 4:
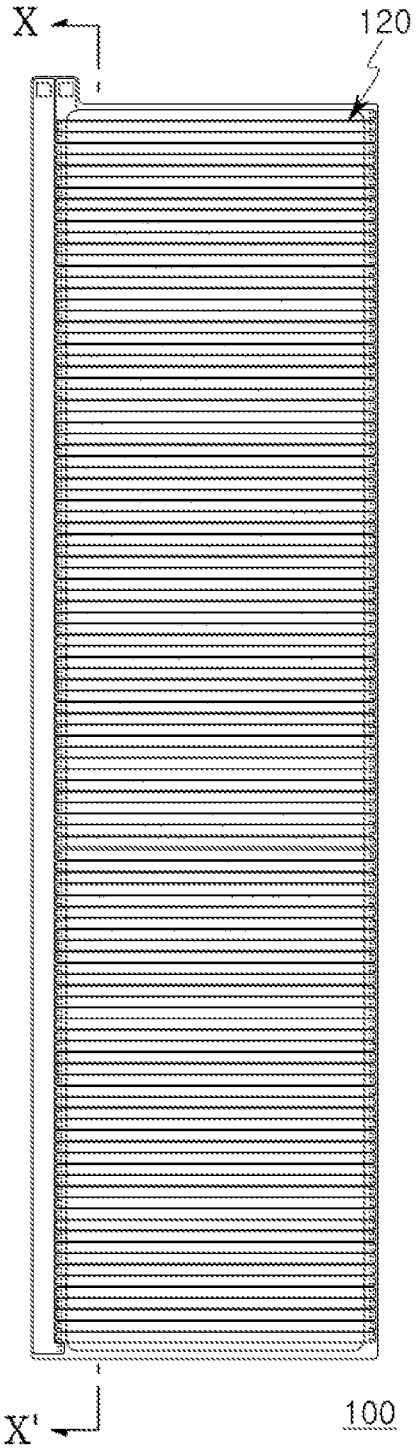
FIG. 4 is a plan view of a wireless communications antenna, according to an embodiment.
Figure 5:
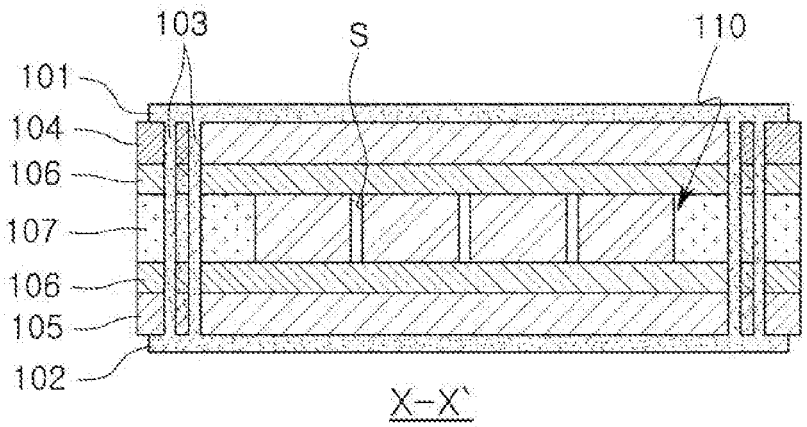
FIG. 5 is a schematic cross-sectional view of the wireless communications antenna of FIG. 4.

Hereinafter, a detailed form of a wireless communications antenna which may be employed, according to an example, will be described. FIG. 4 is a plan view of a wireless communications antenna 100, according to an embodiment. FIG. 5 is a schematic cross-sectional view of the wireless communications antenna 100. In addition, FIGS. 6 through 11 illustrate embodiments of a magnetic body which may be employed in the wireless communications antenna 100.

Figure 6:
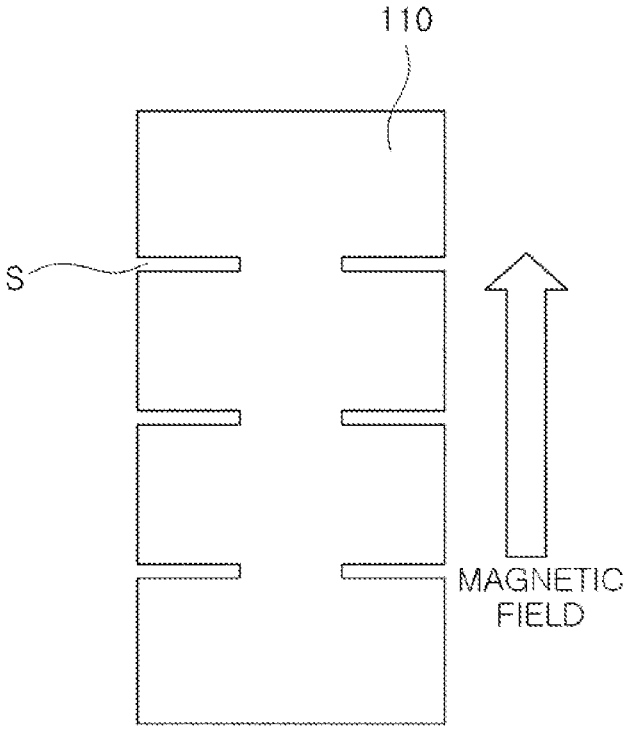
FIGS. 6 through 11 illustrate embodiments of a magnetic body which may be employed in the wireless communications antenna of FIG. 4.

First, referring to FIGS. 4 through 6, the wireless communications antenna 100 may include a magnetic body 110, and a coil part 120 having a solenoid form and having the magnetic body 110 as a core. The magnetic body 110 may include one or more slits S. However, the embodiment of FIGS. 4 through 6 will be described based on a structure in which a plurality of slits S are included. FIG. 6 is a plan view of the magnetic body 110 viewed from the top.

The slits S formed in the magnetic body 110 may function to adjust magnetic flux density by reducing the size of magnetic domains generated by magnetization of the magnetic body 110. When the magnetic field is applied to the magnetic body 110, the magnetic body 110 may be magnetized in a direction of the magnetic field and a size of the magnetic body 110 may change. In such a case, an occurrence of noise due to the change in the size of the magnetic body 110 may be reduced by the slits S. Considering the direction of the magnetic field and a direction of the change in the size of the magnetic body 110, the slits S may be formed in a direction perpendicular to a direction of a magnetic field of the coil part 120 in order to improve a noise reduction effect. In the description herein, the direction of the magnetic field is a direction in which a coil pattern of the coil part 120 is wound and proceeds, and corresponds to the direction of the arrow illustrated in FIG. 6.

The magnetic body 110, which is a core of the coil part 120, may prevent an eddy current and may enforce the magnetic field formed by the coil part. The magnetic body 110 may be formed of a material having high permeability, for example, an amorphous alloy, a nanocrystalline alloy, or a ferrite. In this case, as the amorphous alloy, an Fe-based or Co-based magnetic alloy may be used. A material including silicon (Si), for example, a Fe—Si—B alloy may be used as the Fe-based magnetic alloy. As a content of a metal including Fe is increased, saturation magnetic flux density is increased. However, when the content of a Fe element is excessive, it is difficult to form an amorphous structure. Therefore, the content of Fe may be 70 to 90 atomic %, and, in terms of amorphous formability, it is desirable that a sum of Si and B is in the range of 10 to 30 atomic %. In order to prevent corrosion, corrosion resistant elements such as Cr and Co may be added to such a basic composition in an amount up to 20 atomic %, and a small amount of other metal elements may be included to provide other characteristics, as needed.

In addition, in a case in which the magnetic body 110 is formed of a nano-crystal grain alloy, a Fe-based nano-crystal grain magnetic alloy may be used. For example, a Fe—Si—B—Cu—Nb alloy may be used as the Fe-based nano-crystal grain alloy. In this case, in order to form the nano-crystal grain alloy, an amorphous metal ribbon may be heat-treated at an appropriate temperature. In addition, in a case in which the ferrite is used as the magnetic body 110, a Mn—Zn based ferrite, a Mn—Ni based ferrite, barium (Ba), or an Sr based ferrite may be used.

As described above, the embodiment in which the slits S are formed in the magnetic body 110 to reduce the noise due to the change of the volume of the magnetic body 110 may be effectively applied to a case in which the magnetic body 110 is formed of a material having a relatively large magnetostriction coefficient, for example, a material having a magnetostriction coefficient of 5 or more, and the change in the volume of the magnetic body 110 due to an induced magnetic field is large.

Referring to FIG. 5, the coil part 120 may include a first wiring part 101, a second wiring part 102, and conductive vias 103. In addition, the coil part 120 may include the first substrate 104 and a second substrate 105, and the magnetic body 110 may be disposed between the first and second substrates 104 and 105.

The first wiring 101 and the second wiring part 102 may be formed in a conductive pattern. In addition, the first wiring part 101 may be formed on the first substrate 104 and the second wiring part 102 may be formed on the second substrate 105. In addition, the conductive vias 103 may connect the conductive patterns of the first wiring part 101 and the second wiring part 102 to each other in a region around the magnetic body 110. That is, the wireless communications antenna 100 may include the solenoid magnetic body 110 formed as a core and having the first wiring part 101, the second wiring part 102, and the conductive vias 103 attached to the magnetic body 110.

The first and second substrates 104 and 105, which are thin film substrates, may be, for example, a flexible board such as a flexible printed circuit board (FPCB). However, the first and second substrates are not limited to a FPCB. The first substrate 104 and the second substrate 105 may be attached to the magnetic body 110 by an adhesive sheet 106. The adhesive sheet 106 may be formed of an adhesive tape, and may be formed by applying an adhesive or a resin having adhesive property on a surface of the first and second substrates 104 and 105 or the magnetic body 110.

The coil part 120 may use the coil pattern formed on a thin film without using a coil of a wire form as in the related art. Accordingly, the thin film coil may be formed to be have a very thin thickness. However, the form of the coil part 120 may be varied as needed, and the conventional wire form is not excluded from the embodiments disclosed herein.

The conductive vias 103 may connect the first wiring part 101 and the second wiring part 102 to each other to form a coil of a solenoid form surrounding the magnetic body 110 together with the first and second wiring parts 101 and 102.

As illustrated in FIG. 5, one conductive pattern on the first substrate 104 and one conductive pattern on the second substrate 105 may be connected to each other by two conductive vias 103 to prevent a disconnection between the conductive patterns.

In addition, the wireless communications antenna 100 may include a resin layer 107, which may be formed of a thermosetting resin having insulation and adhesive property. The resin layer 107 may be disposed between the first substrate 104 and the second substrate 105 at an outer portion of the magnetic body 110. Since the resin layer 107 supports the first substrate 104 and the second substrate 105 in an empty space around the magnetic body 110, the resin layer 107 may prevent a failure or defect such as a disconnection or a bubble introduction, which may occur during a manufacturing process or use. In addition, the conductive vias 103 may penetrate through the resin layer 107. In addition, although not illustrated, the wireless communications antenna 100 may include a cover layer. The cover layer may be disposed on the first wiring part 101 and the second wiring part 102 to protect the first wiring part 101 and the second wiring part 102 at the outermost portion of the wireless communications antenna 100.

As described above, in comparison to a conventional communications antenna, the occurrence of noise due to the change in the size of the magnetic body 110 when the wireless communications antenna 100 was driven was significantly reduced by the silts S formed in the magnetic body 110. The number and shape of the slits S may be adjusted by considering the size of the magnetic body 110, the shape and position of the coil part 120, and other parameters. As illustrated in FIG. 6, the magnetic body 110 may have a plurality of slits S. In this case, the plurality of slits S may be spaced apart from each other in a direction (in a direction of the arrow in FIG. 6) parallel to a direction of the magnetic field of the coil part 120. Further, the plurality of slits S may be arranged in a left and right symmetrical structure in relation to a center line parallel to a direction of the magnetic field of the coil part 120 in the magnetic body 110.

As illustrated in FIG. 6, the slits S may be configured (e.g., with respect to length, width, and/or arrangement) such that the magnetic body 110 is not completely severed or completely separated at any region. This is to prevent the magnetic body 110 from being disconnected and to connect a magnetic path of the magnetic body 110. As a result of a structure in which the magnetic path of the magnetic body 110 is not disconnected and is connected (e.g., continuous), a noise reduction effect may be maintained and a problem in which a recognition rate is decreased during wireless communications may be significantly reduced.

Figure 7:
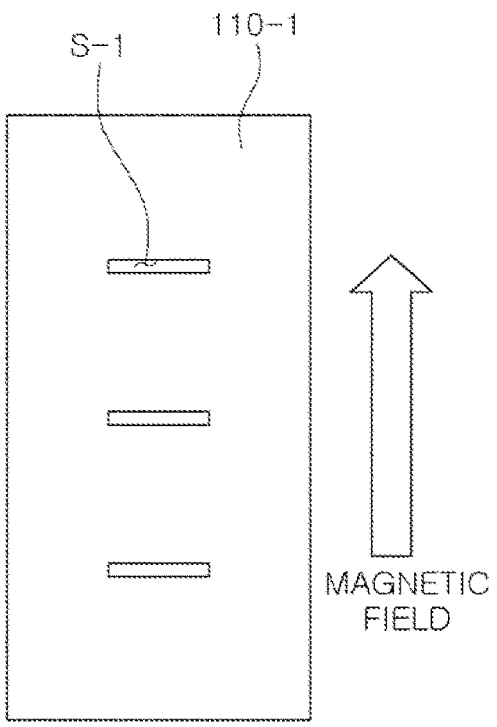

A form of the slits S formed in the magnetic body 110 may be modified. As illustrated in FIG. 7, slits S-1 formed in a magnetic body 110-1 may have a shape extending in a direction perpendicular to the direction of the magnetic field of the coil part 120 from one region in the magnetic body 110-1. In other words, the slits S-1 may be formed in the magnetic body 110-1 and may not be formed on, or exposed on, side surfaces of the magnetic body 110-1.

Figure 8:
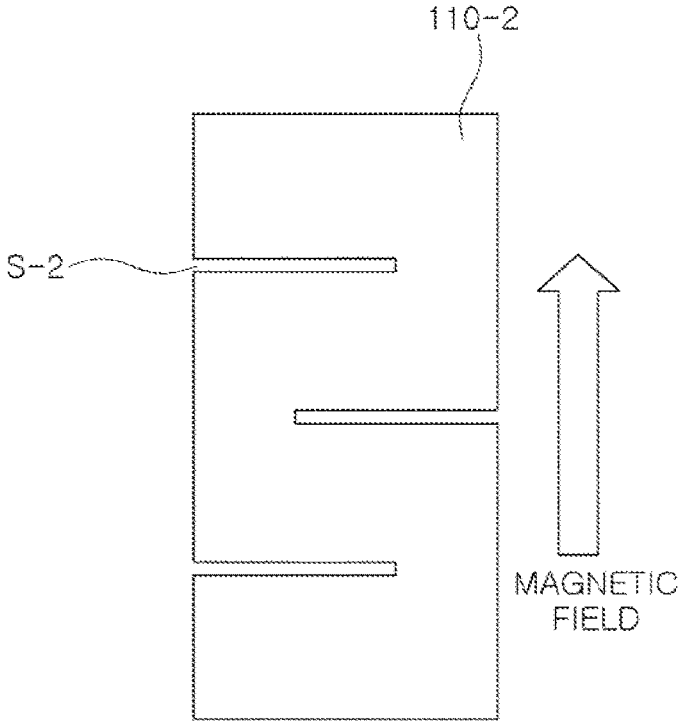

As another modified example, as illustrated in FIG. 8, slits S-2 may be alternately formed on opposite side surfaces of a magnetic body 110-2. Specifically, a slit formed in one side surface of the magnetic body 110-2 among the slits S-2 and a slit formed in the other, opposite side surface of the magnetic body 110-2 among the slits S-2 may be alternately disposed in the direction parallel to the direction of the magnetic field of the coil part 120. Even in a layout form in which the slits S-2 are alternately disposed, noise due to an operation of the magnetic body 110-2 may be reduced. Since the magnetic path is not disconnected and is connected, the problem of the recognition rate during wireless communications being decreased may be significantly reduced.

Figure 9:
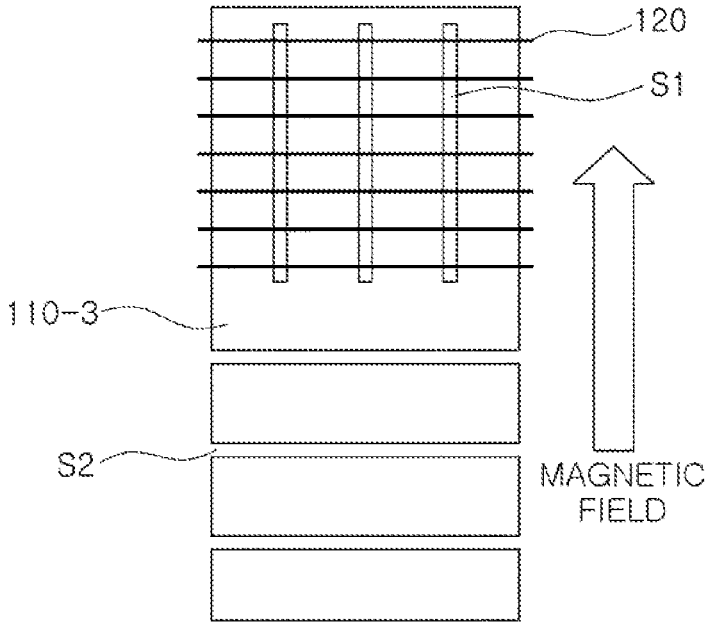

As in a modified example of FIG. 9, slits S1 and S2 in a magnetic body 110-3 may have different forms depending on a region. Specifically, second slits S2 among the slits S1 and S2 may extend in a direction perpendicular to the direction of the magnetic field of the coil part 120, and the first slits S1 among the slits S1 and S2 may extend in a direction parallel to the direction of the magnetic field of the coil part 120. In this case, the coil part 120 may be wound around only a portion of the region of the magnetic body 110-3, and the region in the magnetic body 110-3 in which the coil part 120 is formed may be a region in which the slits S1 extending parallel to the direction of the magnetic field of the coil part 120 are formed. In addition, the region in the magnetic body 110-3 in which the coil part 120 is not formed may be a region in which the slits S2 extending perpendicular to the direction of the magnetic field of the coil part 120 are formed. FIG. 9 illustrates a configuration in which the slits S2 extend from one side surface of the magnetic body 110-3 to the other side surface of the magnetic body 110-3 to separate the magnetic body 110-3 into disconnected pieces. However, as in the embodiments of FIGS. 7 and 8 described above, the slits S2 may also have a shape that does not separate the magnetic body 110-3 into disconnected pieces, so that the magnetic path of the magnetic body 110-3 is connected.

According to the embodiment of FIG. 9, since magnetic flux density in the magnetic body 110-3 is relatively larger in the region in which the coil part 120 is formed, the disconnection of the magnetic path may be significantly reduced by the slit S1 extending in the direction parallel to the direction of the magnetic field in the region in which the coil part 120 is formed. In addition, noise of the magnetic body 110-3 may be reduced by the slit S2 extending in the direction perpendicular to the direction of the magnetic field in the region in which the coil part 120 is not formed.

Figure 10A:
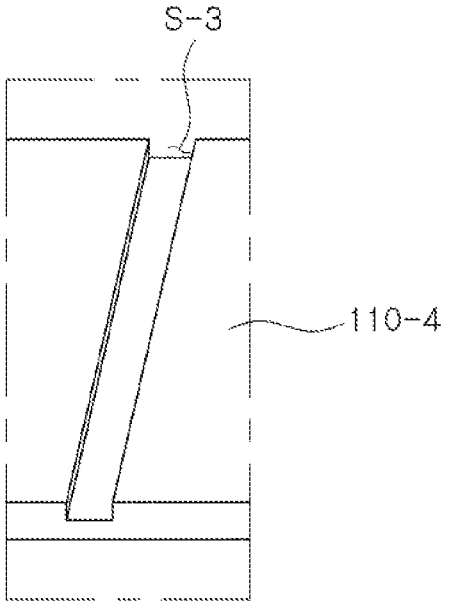
Figure 10B:
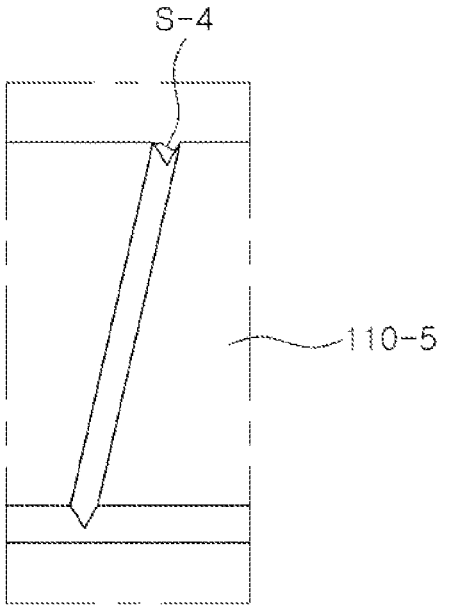

According to the embodiment of FIG. 9, the slit S2 has a structure in which it penetrates entirely through the magnetic body 110-3 in a thickness direction, but the slit S2 may also be implemented in a form that does not penetrate entirely through the magnetic body 110-3. As illustrated in FIGS. 10A and 10B, slits S-3 and S-4 may have a trench shape that does not penetrate entirely through magnetic bodies 110-4 and 110-5 in the thickness direction. FIG. 10A illustrates the magnetic body 110-4 including the slit S-3 having a general flat-bottom trench shape, and FIG. 10B illustrates the magnetic body 110-5 including the slit S-4 having the form of a V-shaped notch.

Figure 11:
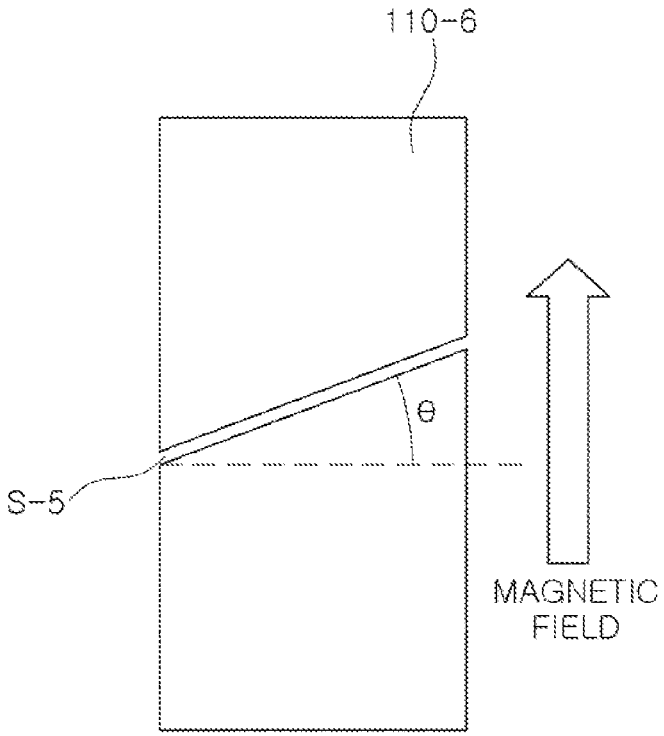

In addition, the embodiments described above illustrates examples in which the slits are formed to be perpendicular or parallel to the direction of the magnetic field of the coil part 120, but the slits may also be disposed at different angles. As illustrated in FIG. 11, a magnetic body 110-6 may have a slit S-5 that is elongated in the direction perpendicular to the direction of the magnetic field of the coil part 120. A gradient or angle θ of the slit S-5 with respect to the direction perpendicular to the direction of the magnetic field of the coil part 120 may be larger than 0° and smaller than 90°.

Figure 12:
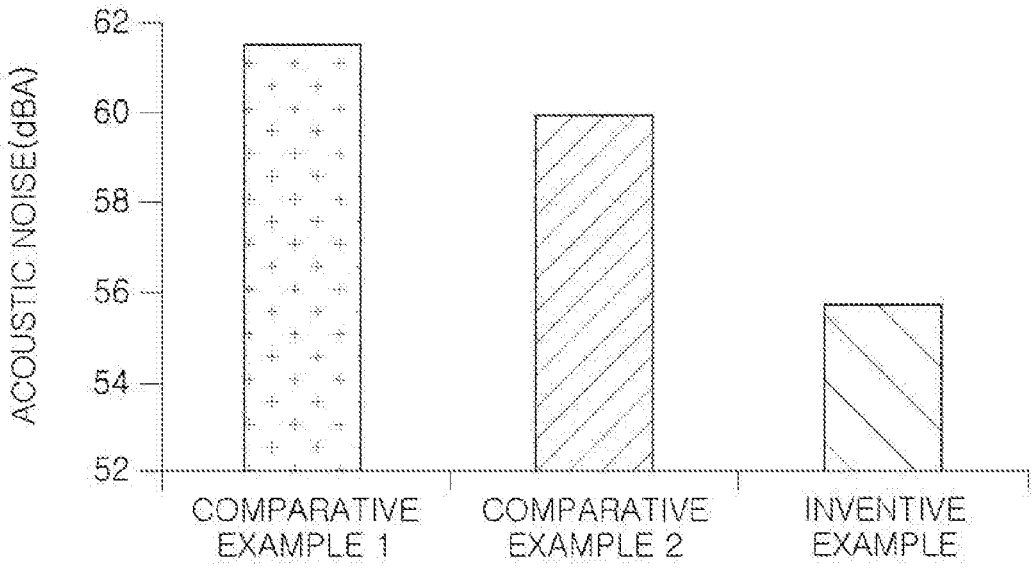
FIG. 12 is a graph illustrating acoustic noise experiment results for a magnetic body obtained according to an embodiment and comparative examples.

FIG. 12 is a graph illustrating acoustic noise experiment results for a magnetic body obtained according to an embodiment and comparative examples.

In a Comparative Example 1, a magnetic body that does not include a slit was used, and in a Comparative Example 2, a magnetic body including only a slit (corresponding S1 in FIG. 9) disposed in the direction parallel to the direction of the magnetic field of the coil part was used. In addition, in an embodiment according to the disclosure herein, the magnetic body 110 as illustrated in FIG. 6 was used. As can be seen from the experimental results of FIG. 12, acoustic noise was reduced when a slit was formed in the magnetic body, and in particular, a noise reduction effect was significantly large when the slit was is formed in the direction perpendicular to the direction of the magnetic field of the coil part as illustrated in FIG. 6.

As set forth above, according to the embodiments disclosed herein, a wireless communications antenna may reduce the occurrence of noise by significantly reducing the influence of a volume change of the magnetic body, and, thus, performance of a mobile device employing the wireless communications antenna may be improved.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A wireless communications antenna, comprising:

a magnetic body comprising one or more slits formed therein; and a coil part having solenoid form and disposed around the magnetic body, wherein the one or more slits are configured such that the magnetic body is not disconnected and a magnetic path of the magnetic body is continuous, and wherein the magnetic body has a magnetostriction coefficient of 5 or more.

2. The wireless communications antenna of claim 1, wherein the one or more slits extend in a direction perpendicular to a direction of a magnetic field of the coil part.

3. The wireless communications antenna of claim 2, wherein the one or more slits have a shape extending in the direction perpendicular to the direction of the magnetic field of the coil part from side surfaces of the magnetic body.

4. The wireless communications antenna of claim 3, wherein the one or more slits are spaced apart from each other in a direction parallel to the direction of the magnetic field of the coil part.

5. The wireless communications antenna of claim 4, wherein the one or more slits are arranged in a left and right symmetrical structure in relation to a center line parallel to the direction of the magnetic field of the coil part in the magnetic body.

6. The wireless communications antenna of claim 4, wherein a slit, among the one or more slits, formed on one side surface of the magnetic body and a slit, among the one or more slits, formed another side surface of the magnetic body are alternately disposed in the direction parallel to the direction of the magnetic field of the coil part.

7. The wireless communications antenna of claim 2, wherein the one or more slits have a shape extending in the direction perpendicular to the direction of the magnetic field of the coil part in one region in the magnetic body.

8. The wireless communications antenna of claim 7, wherein the one or more slits are not formed on side surfaces of the magnetic body.

9. The wireless communications antenna of claim 1, wherein the one or more slits are inclined at an angle wider than 0° and narrower than 90° with respect to a direction perpendicular to a direction of a magnetic field of the coil part.

10. The wireless communications antenna of claim 1, wherein the one or more slits penetrate through the magnetic body in a thickness direction.

11. The wireless communications antenna of claim 1, wherein the one or more slits have a trench shape that does not penetrate entirely through the magnetic body in a thickness direction.

12. The wireless communications antenna of claim 1, wherein the coil part comprises a first wiring part disposed on a first surface of the magnetic body, a second wiring part disposed on a second surface of the magnetic body, and conductive vias connecting the first wiring part and the second wiring part to each other.

13. A wireless communications antenna comprising:

a magnetic body comprising slits formed therein; and a coil part having solenoid form and disposed around the magnetic body, wherein first slits, among the slits are formed in a direction perpendicular to a direction of a magnetic field of the coil part, and second slits, among the slits, are formed in a direction parallel to the direction of the magnetic field of the coil part, and wherein the magnetic body has a magnetostriction coefficient of 5 or more.

14. The wireless communications antenna of claim 13, wherein the coil part is wound around only a region of the magnetic body in which the second slits are formed.

15. The wireless communications antenna of claim 13, wherein the coil part is not formed in a region of the magnetic body in which the first slits are formed.

16. The wireless communications antenna of claim 13, wherein the first slits are disposed in a first portion of the magnetic body and separate the first portion of the magnetic body into disconnected pieces.

17. The wireless communications antenna of claim 16, wherein the second slits are formed in a second portion of the magnetic body and do not separate the second portion of the magnetic body into disconnected pieces.

18. The wireless communications antenna of claim 17, wherein the coil part is wound around only the second portion of the magnetic body.

* * * * *